US008547005B1

(12) United States Patent
Smith et al.

(10) Patent No.: US 8,547,005 B1
(45) Date of Patent: Oct. 1, 2013

(54) MULTI-LAYER HEATER FOR AN ELECTRON GUN

(75) Inventors: Peter Clark Smith, Half Moon Bay, CA (US); Robert W. LeClair, Pleasanton, CA (US)

(73) Assignee: Superior Technical Ceramics, Inc., St. Albans, VT (US)

( * ) Notice: Subject to any disclaimer, the term of this patent is extended or adjusted under 35 U.S.C. 154(b) by 208 days.

(21) Appl. No.: 12/851,562

(22) Filed: Aug. 6, 2010

Related U.S. Application Data

(60) Provisional application No. 61/345,605, filed on May 18, 2010.

(51) Int. Cl.
*H01J 1/15* (2006.01)

(52) U.S. Cl.
USPC ..... 313/341

(58) Field of Classification Search
USPC ..... 313/341
See application file for complete search history.

(56) References Cited

U.S. PATENT DOCUMENTS

| | | | | |
|---|---|---|---|---|
| 4,671,777 | A * | 6/1987 | van Esdonk et al. | 445/51 |
| 4,912,305 | A | 3/1990 | Tatemasu | |
| 5,331,134 | A | 7/1994 | Kimura | |
| 5,350,969 | A | 9/1994 | Gattuso | |
| 5,686,790 | A * | 11/1997 | Curtin et al. | 313/493 |
| 5,701,233 | A | 12/1997 | Carson et al. | |
| 6,653,787 | B2 | 11/2003 | Watkins et al. | |
| 6,861,165 | B2 | 3/2005 | Hiramatsu et al. | |
| 6,878,946 | B2 | 4/2005 | Farley et al. | |
| 6,888,106 | B2 | 5/2005 | Hiramatsu | |
| 6,929,874 | B2 | 8/2005 | Hiramatsu et al. | |
| 7,224,256 | B2 | 5/2007 | Parsons | |
| 7,274,006 | B2 | 9/2007 | Okajima et al. | |
| 7,345,260 | B2 | 3/2008 | Unno | |
| 7,519,159 | B2 | 4/2009 | Radley et al. | |
| 2006/0082433 | A1 * | 4/2006 | Parsons | 338/25 |

* cited by examiner

*Primary Examiner* — Anh Mai
*Assistant Examiner* — Michael Santonocito
(74) *Attorney, Agent, or Firm* — File-EE-Patents.com; Jay A. Chesavage

(57) ABSTRACT

The electron emission portion of a cathode for an electron gun has layers of substrate material formed from a ceramic powder such as Aluminum nitride. The substrate layers have conductive traces formed on them, the conductive traces made from sintered tungsten or alternatively a refractory foil. When current is passed through the conductive traces, heat is coupled to a cathode which is thermally coupled to the heater assembly. In another embodiment of the invention, one of the layers of the heater includes a thermionic emission material and optionally a work function lowering material such as BaO, which allows the outer layer of the multi-layer heater to directly emit electrons. In another embodiment of the invention, a control grid is formed on a layer above the thermionic cathode layer, which provides for a complete electron gun assembly having a heater, cathode with a reduced work function material, and control grid to be fabricated as a single unit at the same time.

29 Claims, 10 Drawing Sheets

*Figure 1*
Cathode Heater Assembly
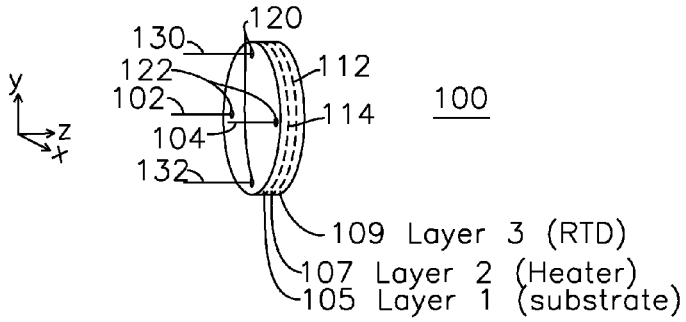
*Figure 2A*
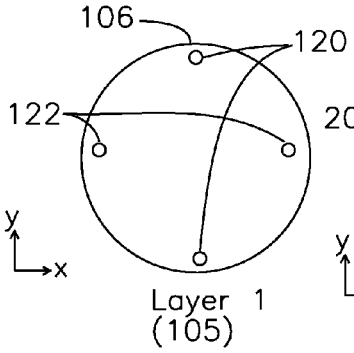
*Figure 2B*
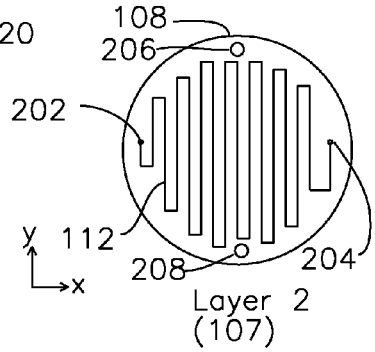
*Figure 2C*
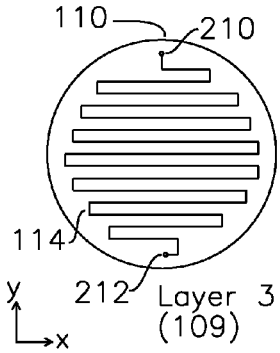
*Figure 3A*
Stacked (pre-lamination) Layers
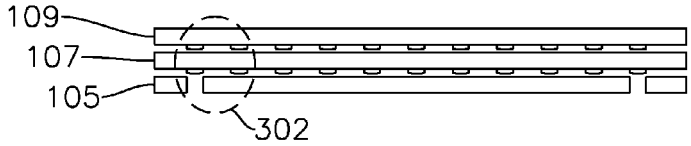
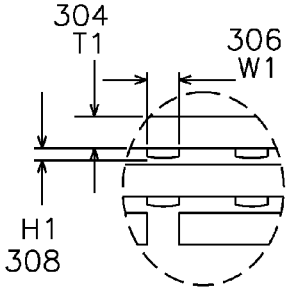
*Figure 3B*
Detail view of pre-lamination layers Stacked (post-lamination) Heater Layers Post-lamination, pre-baked monolith Post-lamination, post baked monolith Post-sintered monolith Lead Attach Sintering fabrication process steps

*Figure 7*
Assembled Cathode and Heater Assembly
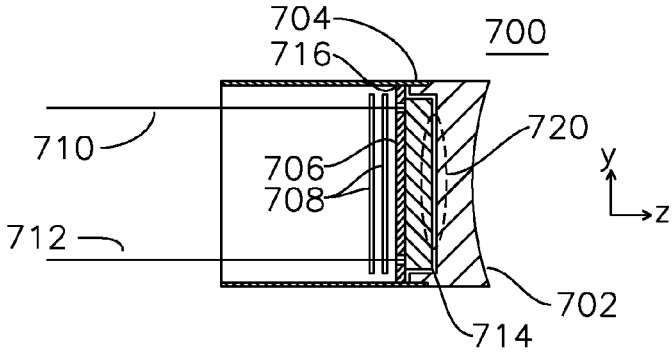
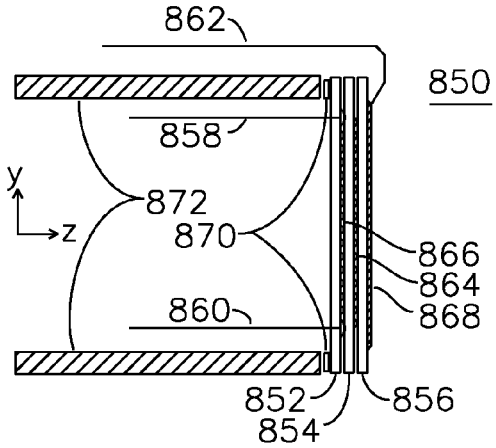
*Figure 8A*
Integrated Flat Cathode and Heater Assembly (cathode side traces)

Integrated Electron Gun with control grid, Flat Cathode, and Heater Assembly

Hot Press fabrication process steps

Integrated Anode/Cathode/Heater Assembly

Dispenser Cathode

Surface Printed Cathode Heater

Liquid Ceramic Coating over Traces over Substrate

MULTI-LAYER HEATER FOR AN ELECTRON GUN

The present application claims priority of provisional patent application 61/345,605 filed May 18, 2010.

FIELD OF THE INVENTION

The present invention relates to an integrated heater assembly for an electron gun. In particular, the invention relates to a multi-layer thick film heater for use with a thermionic cathode in an electron gun.

BACKGROUND OF THE INVENTION

An electron gun uses thermionic emission of electrons from a heated cathode. Electrons are released from the cathode when the thermionic energy of the cathode exceeds the work function energy which restrains the electrons. Electrons which are released from thermionic emissions are accelerated from the cathode surface using an anode which is positively charged with respect to the thermionic cathode. The emitted electrons may then be formed into an electron beam, and the resulting beam may be formed into a variety of shapes and profiles for use in traveling wave tubes, klystrons, gyrotrons, cathode ray tubes, and a wide variety of electron devices which operate through the coupling of energy into and out of an electron beam, or through the steering of an electron beam. One structure present in an electron gun is a heater element, often in the form of a helical tungsten wire which is supplied with a direct current (DC) or alternating current (AC), which produces resistive heating with a power dissipation equal to the heater voltage multiplied by the heater current. The resultant thermal energy of the heater assembly is conducted to the thermionic cathode which is typically formed using powder metallurgy of a refractory metal such as tungsten. A tungsten cathode formed in this manner has pores in the voids between the sintered powder grains, and these pores are often filled with a work function lowering material such as BaO which allows a greater density of electrons to be generated by a given thermal energy at the cathode emission surface. A porous cathode which provides a reservoir of work function lowering material is known as a dispenser cathode. The front surface of the cathode may have a concave shape to produce an electron beam profile associated with a magnetically confined beam such as a Pierce electron gun, or the front surface may be flat for an unconfined flow electron gun. A control grid may be placed in front of the cathode electron emitting surface and a voltage applied to the control grid which modulates the strength of the electron beam by interposing an electrostatic potential with a conductive grid through which the electrons flow, the conductive control grid placed between the negatively charged cathode and the positively charged anode.

In the prior art, each of the components of the electron gun are separately formed in unrelated processes. The heater assembly in the prior art is typically a coil of tungsten wire thermally coupled to the cathode using a potting agent, where the cathode is sintered from powdered tungsten, and the control grid is a stamped or etched sheet of molybdenum, halfnium, or oxygen-free copper, and separate process steps and structures are required to form each element, and a separate assembly process step supports each element in its respective location.

Additionally, in the prior art, the heater assembly is one of the primary reliability elements which contributes to early electron tube failure. One failure mechanism in prior art tungsten heaters is caused by an interaction between the high temperature heater and the potting material used to support and electrically insulate the heater from the cathode. Over time and multiple thermal cycles, potting compounds such as $Al_2O_3$, may contain trace contaminate materials, outgas and these released gasses enter the evacuated chamber of the electron gun and degrade beam performance. Additionally, the contaminate materials may contain carbon or ionic materials, which the high electrical gradients in the region of the cathode assembly will cause to become attracted and concentrate in this region, eventually forming arc paths and leading to catastrophic failure of the electron gun assembly.

An improved heater assembly is desired which may be secured to a cathode without the need for potting compounds and with higher thermal conductivity than potting compounds offer. Additionally, an improved cathode assembly is desired which integrates process steps for the fabrication of the cathode with the fabrication of the heater in a co-fired sintering process. Additionally, an improved electron gun assembly is desired which integrates the fabrication of the cathode with the fabrication of the heater and control grid in a co-fired sintering process. Additionally, an improved electron gun assembly is desired which provides improved thermal uniformity of the entire cathode surface.

OBJECTS OF THE INVENTION

A first object of the invention is a multi-layer heater formed from a plurality of layers of Aluminum Nitride formed into a tape, the tape perforated at inter-layer connection regions, the tape printed with an ink containing a refractory metal such as tungsten, at least one layer of the tape having traces formed from a refractory metal and thereby forming a heater layer, an optional layer of tape having traces formed from a refractory metal for measurement of operational temperature of the heater, the multiple layers of tape with refractory metal ink placed in contact with each other and laminated together into a monolithic form, the monolithic form thereafter heated with a temperature and pressure sufficient for ceramic and metallic particle consolidation from a process such as hot pressing or sintering, the consolidation operative on both the Aluminum Nitride ceramic and the refractory metal ink of the layers to form conductive traces suitable for heating an electron gun cathode.

A second object of the invention is an integrated electron emitting cathode formed from a plurality of layers of ceramic powder such as Aluminum Nitride formed into a tape, the tape perforated at inter-layer connection regions, each layer of tape printed with an ink containing a refractory metal such as Tungsten which can be sintered into conductive traces for use as a cathode heater, where one of the outer layers contains an electron emission surface with a work function lowering material such as BaO, which is heated to an electron emission temperature by the adjacent heater.

A third object of the invention is an integrated electron gun assembly formed from a plurality of layers of Aluminum Nitride formed into a tape, the tape perforated at inter-layer connection regions, each layer of tape printed with an ink containing a refractory metal such as tungsten in powdered or etched metal form forming traces which can be sintered or hot pressed, where one of the outer layers contains a grid control surface or surfaces for the control of emitted electrons, and where an adjacent layer contains an electron emission surface, and where subsequent layers contain heater traces, where the layers having heater traces and control grid traces are formed from a refractory metal such as tungsten, and the electron emission layer is formed from either bare ceramic or sintered or hot pressed tungsten, the cathode operative with a work function lowering material such as BaO.

A fourth object of the invention is a heater for a cathode having a planar or non-planar substrate formed and sintered from aluminum nitride or another suitable thermally conductive ceramic, the substrate printed with a refractory metal such as tungsten to form metal conductive heater traces, where the traces are optionally covered with an additional ceramic layer.

SUMMARY OF THE INVENTION

One embodiment of the invention is a multi-layer heater, the multi-layer heater formed from a plurality of individual layers, each layer having a substrate of Aluminum Nitride (AlN) with tungsten traces which can be printed onto the substrate of each layer as a powdered tungsten paste and subsequently densified into conductive heater traces through the application of elevated temperature and pressure.

Another embodiment of the invention is an integrated cathode, the integrated cathode having a heater formed from a plurality of layers containing electrically conductive heater traces and an electron emitting cathode layer thermally coupled to the heater layers. The heater trace layer and an optional RTD trace layer are laminated together, with the cathode preferably placed on an outer surface where pores may be formed into the surface or throughout the thickness of the cathode, such as by mixing either an additional layer of aluminum nitride ceramic or a layer of tungsten mixed with a fugitive material such as an organic salt which burns off during the post lamination baking process, where the baking process also removes organic binders in the tape, or during the densification process such as sintering or hot pressing, thereby leaving voids and pores in the cathode surface for subsequent infiltration of work function lowering materials such as BaO in a final step of the process. The introduction of BaO in these voids is preferably done as a final step because the BaO evaporation rate may be excessive at the sintering temperature of tungsten, which would cause the BaO to be lost if applied before the tungsten sintering step. The evaporative loss of BaO at sintering temperatures may be significant where the BaO is disposed at the same time as the densification or sintering cycle, as the sintering or hot pressing densification process elevates the temperature of the various layer structures and results in a change in composition of the monolith into a hard ceramic during densification, where the ceramic powder consolidates and inter-particle voids are reduced. During the elevated temperature of densification, it may be difficult to simultaneously diffuse BaO while sintering or hot-pressing the tungsten or the ceramic (a process known as co-firing) because BaO melts at 1918 C and boils at 2000 C, whereas the co-firing of the BaO with the sintering process for tungsten would typically be done at a temperature of approximately 1850 C, possibly resulting in significant BaO losses during densification.

In one embodiment of the invention, during a lamination step, the heater layer, an optional RTD layer for temperature measurement, and cathode layer are pressed together such that the AlN tape and tungsten traces plastically deform around each other to create a monolith of post-laminated AlN with embedded traces in inner layers. The laminated monolith is then sintered, during which the controlled pores formed in the cathode tungsten powder during post-lamination baking persist in the cathode layer emission surface. After the densification step (which may be done by sintering, hot pressing, or any high temperature consolidation method), metallic leads can be attached to the heater and cathode assembly using a subsequent sintering process (or the leads fixtured and sintered during the previous sintering step, or alternatively attached as part of a hot pressing inter-layer diffusion step), after which a work function lowering material such as BaO is infiltrated into the pores of the cathode. In one embodiment of the invention, the laminated integrated cathode has a flat electron emission surface, and in another embodiment of the invention, the cathode part of the invention is built up in layers and laminated with a spherical impression or mold surface to create a concave spherical or arbitrarily shaped electron emission surface.

Another embodiment of the invention is an integrated electron gun, the integrated electron gun having a heater formed from a plurality of layers containing heater traces, an electron emitting cathode layer thermally coupled to the heater layers, and a control grid layer or plurality of control grid layers placed on the cathode layer and on the opposite side of the heater layers. The heater layers, cathode layers, and control grid layers are co-fired or sequentially fired during a high temperature densification process, such as sintering or hot pressing, where each of the heater layers and control grid layers is a substrate containing aluminum nitride with traces printed using a tungsten powder ink, and the cathode layer is a substrate containing aluminum nitride and coated with a mixture of tungsten powder. In one example embodiment, the grid layer has apertures surrounding the electrodes which provide subsequent access to the voids of the cathode layer for introduction of the work function lowering material. The cathode layer voids were created through the evaporation of fugitive particles embedded in the cathode layer during the print process, which voids persist after the post lamination baking step. After sintering of the monolith having laminated heater layers, cathode layer, and grid layer, a work function lowering material such as BaO is infiltrated into the pores and voids of he cathode layer which is accessible in the apertures which surround the co-fired conductive grid layer.

Another embodiment of the invention adds an isolated layer known as a Resistive Temperature Detector (RTD) layer and containing a trace formed from tungsten or other suitable conductive or refractory metal and positioned on a layer adjacent to the cathode for use in estimating the temperature of the cathode by measuring the trace resistance in combination with the thermal coefficient of resistivity of the conductive trace to estimate the cathode temperature.

Another embodiment of the invention is the application of a liquid form of the substrate such as by painting, spraying, or blade application of a liquid slurry of aluminum nitride (or other green ceramic) particles in liquid suspension over the outer layer including conductive traces on the outer layer of a green or fired ceramic monolith to provide dielectric isolation of conductive traces on the outer surface to any adjacent structure such as a cathode which may be placed adjacent to the densified monolith.

These embodiments of the invention provide many advantages over the prior art tungsten wire heaters potted into a cathode. As described previously, the AlN substrate and tungsten traces are generally free of impurities which can later outgas into the electron tube. The multi-layer heater of the present invention provides a physically smaller heater element than the helical coil heaters of the prior art. As AlN has less mass than the prior art tungsten coil plus potting compound, the resulting cathode assembly is lighter, and the increased thermal conductivity of AlN compared to prior art potting agents provides a faster cathode heating rate.

BRIEF DESCRIPTION OF THE DRAWINGS

FIG. 1 shows a perspective view of a cathode heater assembly according to the present invention.

FIG. 2A shows a top view of layer 1 of FIG. 1.

FIG. 2B shows layer 2 of FIG. 1.

FIG. 2C shows layer 3 of FIG. 1.

FIG. 3A shows the diagram for a cross section of a printed tungsten heater before lamination.

FIG. 3B shows a detail view of FIG. 3A.

FIG. 7 shows a cross section view of an assembled cathode and heater assembly.

FIG. 8A shows the cross section view of an alternative embodiment of an integrated flat cathode and heater assembly formed using cathode-side traces.

DETAILED DESCRIPTION OF THE INVENTION

Figure 4A:
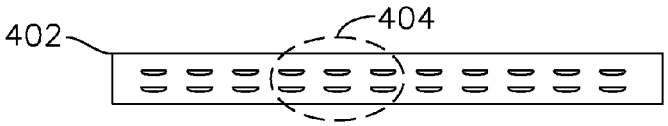
FIG. 4A shows the diagram for a cross section of a printed tungsten heater after lamination.

FIG. 1 shows a cathode heater assembly 100 according to one example embodiment of the present invention. In FIG. 1, the heater 100 is formed from three individual layers, each layer having a moldable aluminum nitride substrate optionally printed with a tungsten powder ink. The moldable layers are laminated together in a plastic deformation lamination process which removes the layer boundaries to form a monolith but preserves the traces printed on each layer where the traces contain an ink containing tungsten powder. FIG. 1 shows an example embodiment of the invention after sintering of the monolith into a ceramic with internal conductors forming heater traces 112 attached to heater leads 102 and 104, and optional resistive temperature detector (RTD) layer 109 with RTD leads 130 and 132. A first layer 105 has a substrate layer of Aluminum Nitride which does not contain traces but provides apertures 122 and 120 for attachment of lead wires to the heater layer 107 and RTD layer 109, where the heater layer 107 is formed from aluminum nitride substrate with metalized traces 112 coupled to heater lead wires 102 and 104, and the Resistance Temperature Detector (RTD) layer 109 is also an aluminum nitride substrate which is metalized with tungsten ink traces 114 and has leads connected to RTD sensor leads 130 and 132.

Several sequential steps are used to form the final cathode heater assembly of FIG. 1. Pre-consolidated ceramic powder with binders is referred to as "green" ceramic, ceramic powder which has been consolidated at elevated temperature or pressure is known as "post-fired" ceramic, and the densification of multiple structures during one elevated temperature cycle are referred to as "co-fired". The individual layers of plastic Aluminum Nitride tape, also known as "green layers", are formed as shown in FIGS. 2A, 2B, and 2C, and certain layers 107 and 109 having conductive traces formed using tungsten powder ink applied to the associated substrate. FIG. 2A shows a first layer 105 with no ink applied, where the substrate 106 is Aluminum Nitride with a pre-lamination thickness on the order of 0.006 inch, the substrate 106 providing apertures 122 and 120 for electrical connection to the tungsten ink traces of layer 2 107 and layer 3 109, respectively. FIG. 2B shows the heater layer 107 with deformable AlN substrate 108 having a trace 112 formed between a first lead attach land 202 for subsequent connection to first lead 102 and second lead attach land 204 for subsequent connection to second lead 104. The heater layer 107 also has perforations 206 and 208 which provide for coupling of the electrical potential of the heater leads and attach lands to the optional RTD layer 3 109. FIG. 2C shows the optional RTD layer 109, which may have traces arranged in the same direction, or orthogonally to the traces of heater layer 2 107.

For a sintered densification process, the traces 112 of layer 2 107, and 114 of layer 3 109, are initially non-conductive or partially conductive tungsten powder ink with a binder which provides for printing using screen masks, such as a traditional silkscreen printing process. The traces 112 and 114 become usable as conductors after a sintering process step which occurs following a lamination step. After the lamination of layers into a monolith, the baking of the monolith, and the sintering of the monolith, the embedded traces shown in FIGS. 2B and 2C become conductive with the printed powder tungsten sintering into conductive traces, and the heater trace 112 receives electrical current from leads passed through perforations 122 of the first layer and electrically attached to lands 202 and 204 of the heater layer 107. Similarly, the RTD layer of FIG. 2C receives current from leads 130 and 132 which pass through apertures 120 of the first layer 105, apertures 206 and 208 of the second layer 107, and which attach to lands 212 and 212, respectively, of the RTD layer 110. Although a single heater layer 108 is shown, the heater may have as many layers as desired, each additional layer stacked above or below layer 2 107 and configured with substrate perforations to have traces which are in series or in parallel with heater trace 112 of FIG. 2B. The RTD layer 109 is preferably placed closest to the cathode and opposite layer 1 105, such that an accurate estimate of cathode temperature may be made. The RTD layer 109 provides an estimate of temperature through the measurement of electrical resistance of the trace 114 in combination with the coefficient of resistance change per temperature change of conductor 114, such by using a look-up table which relates measured resistance to a temperature, or by use of an equation which expresses temperature as a thermal coefficient of resistance in either linear first order or higher order form. Each layer 105, 107 through 109 has a pre-lamination substrate thickness on the order of 0.006 inch AlN substrate with printed traces which are 0.001 inch thick by 0.0015 wide before lamination, and plasticity and moldability of the layers during lamination is provided by small scale air bubbles which are disposed in the substrate, as will be described. For a hot-pressing densification step, refractory metal foil such as tungsten or molybdenum can be used to form the heater traces 112 or RTD traces 114, with the traces formed by etching or stamping the foil as is known in the art of metal fabrication.

The arrangement of traces 112 on substrate 108 of the heater layer 107 shown in FIG. 2B may be arranged in any manner. In one embodiment, the heater layer traces 112 are arranged to minimize the generated magnetic field from current flowing through the heater conductors. This may be done as shown in FIG. 2B with adjacent traces carrying counter-propagating current such that the magnetic fields generated by adjacent conductors cancel. In another embodiment, the heater layer is formed using two adjacent layers, each layer carrying current in an opposite direction to that of the adjacent layer.

FIG. 3A shows a cross section view of the pre-lamination multi-layer heater assembly shown with three layers for clarity in understanding the invention. A typical heater monolith may have one heater layer such as 107, none or one RTD layer 109, and one substrate layer 105 for lead attachment. Optionally, any number of additional substrate layers without traces such as 105 may be added above or below the heater and optional RTD layers for lead attachment or to vary the mechanical thickness or shape of the finished device, and in certain example embodiments to be described later, to add a thermionic emission cathode layer as an alternative to bonding the heater of FIG. 1 to a cathode, and optionally to further add a grid control layer above a cathode layer. For understanding of the lamination process and plastic deformation of the layers into a post-laminated monolith heater structure, region 302 is shown in detail view FIG. 3B with substrate 109 having a nominal thickness T1 304 of 0.006 inch, and printed tungsten powder ink traces having a width W1 306 of 0.0015 inch and height H1 308 of 0.0007 inch prior to the lamination step. A lamination step occurs with a pressure and optional mildly elevated temperature sufficient to ensure plastic flow of the substrate layers to encapsulate the printed tungsten powder traces, as shown in FIG. 4A. This reduction of radiated magnetic field from the heater conductors reduces the undesired associated magnetic field influence on electrons which leave the cathode, which emitted electrons would otherwise be subject to undesirable temporally varying accelerations or deflections due to these undesired magnetic fields in the vicinity of the cathode.

Figure 4B:
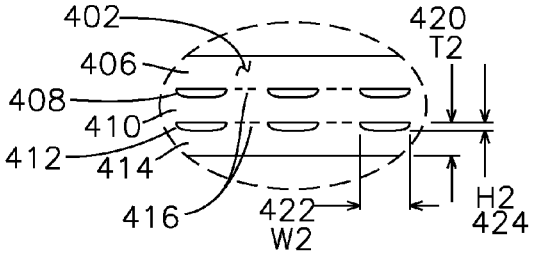
FIG. 4B shows a detail region of FIG. 4A after lamination and before baking.

FIG. 4A shows a the post lamination view of layers 105, 107, 109 of FIG. 3A, where the substrates and traces have plasticly deformed to remove the boundaries between layers, leaving embedded tungsten powder traces and ink binders in pre-baked laminated monolith 402 shown in region 404 in detail FIG. 4B.

Figure 4C:
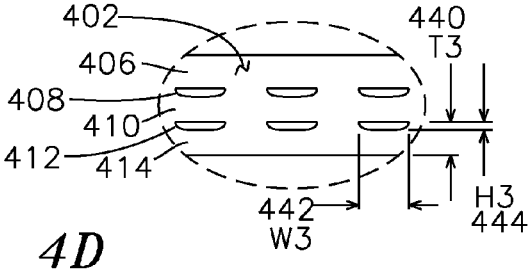
FIG. 4C shows a detail region of FIG. 4A after lamination and baking.

FIG. 4B shows the tungsten powder ink traces from the first layer 105, second layer 107 and third layer 109 plasticly formed together under pressure and optional low temperature increase in the lamination process, which forms the layers into monolith 402, where respective first layer 414, second layer 410 with powder traces 412, and third layer 406 with tungsten powder traces 408 are consolidated and molded together with delineations between boundary layers removed (boundaries 416 are not present, but shown for reference with respect to pre-lamination boundaries between layers 105, 107, 109 of FIG. 3). During application of lamination pressure and optional elevated lamination temperature, the post-laminated monolith aluminum nitride substrates 406, 410, and 414 surround and capture printed tungsten ink traces 408 and 412 as shown in FIG. 4B. After lamination, the printed ink traces have a nominal post-lamination, pre-baking width W2 422 of 0.001 inch, and height H2 424 of 0.0007 inch. The post lamination monolith 402 is known as a "pre-baked green monolith" and is then ready for a baking process step, during which time the volatiles and other compounds in the green monolith 402 are removed by diffusing through the bulk of the monolith 402. Post lamination baking preferably occurs at a temperature typically above 200 degrees C. and below 600 degrees C. for a duration of 4 hours, or until such time as the volatiles have been removed from the green monolith 402. The dimensions of the features of the post-baked green monolith 402 are shown in FIG. 4C, where the trace widths W3 442 are essentially unchanged from those as formed.

Figure 4D:
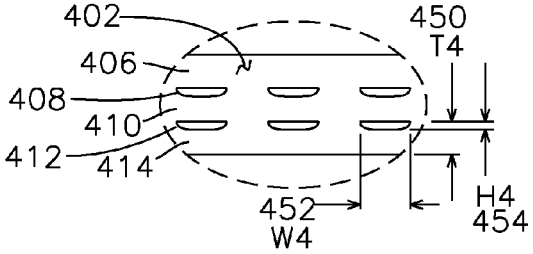
FIG. 4D shows a post-densification cross section of a heater monolith such as following sintering or baking.

After the baking process, a sintering step occurs which transforms the structure of the monolith 402 to a post-sintered monolith, during which step the AlN powder becomes a ceramic and the tungsten powder traces become sintered conductors. Sintering occurs at a sintering temperature for AlN and Tungsten in the range of 1820 C to 1850 C which is applied for 4 hours, during which time the traces and substrates shown in FIG. 4D have post-sintered widths of 80 to 85% of those as formed due to densification and consolidation of the powders of the ceramic substrates and refractory metal traces. In the case of forming via hot pressing, significantly less net dimensional consolidation will occur.

Figure 5:
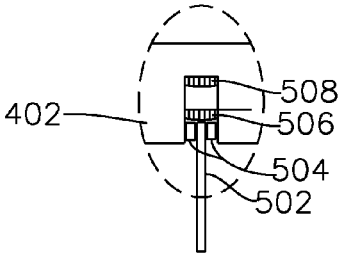
FIG. 5 shows a cross section of a lead attachment into the heater monolith.

After the consolidation step by sintering or hot-pressing, heater leads or RTD leads may be attached in a subsequent operation shown in FIG. 5 by placing lead 502 with tungsten powder 504 in a substrate aperture formed into sintered monolith 402 for connection to an inner trace layer 506 or 508 (both shown for clarity, although only a single layer connection would typically be made for each of the RTD layer and heater layer for the device of FIG. 1). During a lead attachment sintering step, which may be either the a co-fired sintering step which produced ceramic and sintered tungsten of FIG. 4D, or in a separate sintering step associated with lead attachment, the sintered tungsten 504 bridges and forms and electrical attachment to trace layers 506 or 508.

Figure 6A:
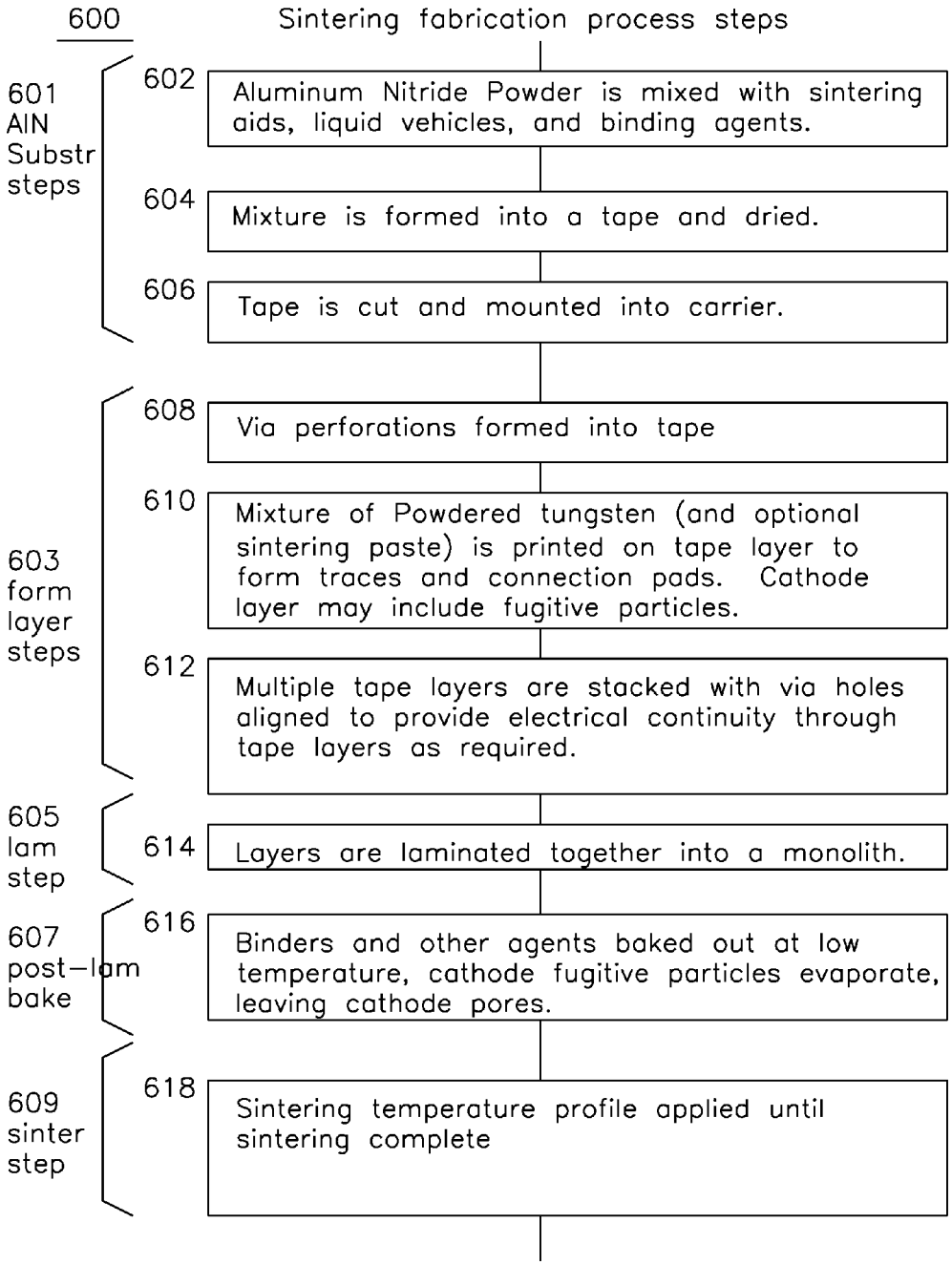
FIGS. 6A and 6B show one embodiment of sintering process steps for fabricating the heater of FIG. 1.
Figure 6B:
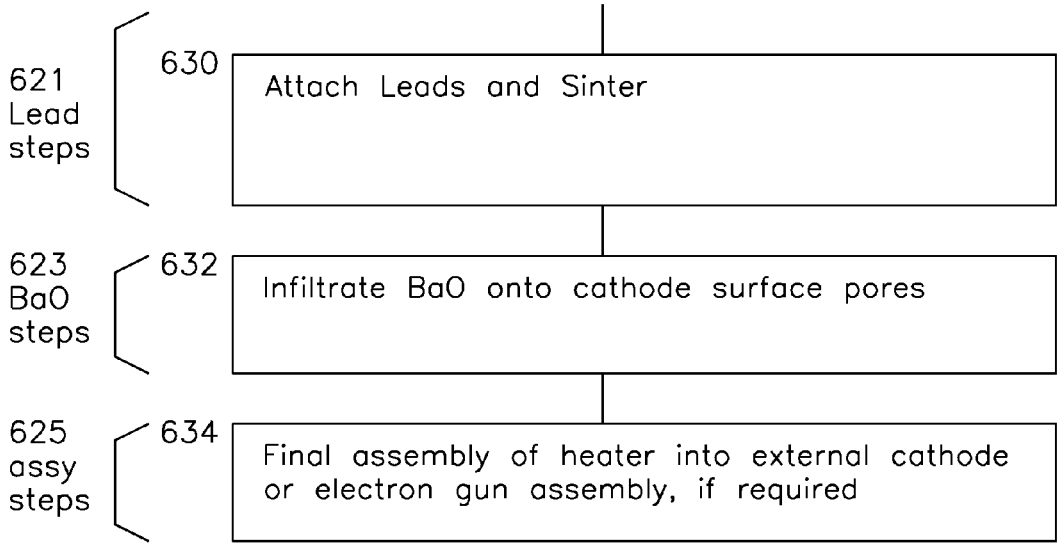

FIGS. 6A and 6B show an example process 600 which may be used to form the heater assembly of FIG. 1. The process steps are shown in a particular sequence to aid in understanding the invention, but some process steps may be done concurrently, or separately from other process steps, or in a different order than shown. The general flow of the process 600 of FIGS. 6A and 6B provides a series of steps 601 for the formation of the substrate tape, which may be any deformable material which sinters into a ceramic form, but is shown for AlN. The next series of steps 603 relates to the formation of layers before lamination, as was described for FIG. 3A. The next step is the lamination step 605 which produces the structure shown in FIGS. 4A and 4B, followed by a post lamination bake 607 which produces the structure shown in FIG. 4C. Process step 609 is the sintering step which converts the laminated green monolith into a ceramic sintered monolith of FIG. 4D. One example of lead attachment step 621 of FIG. 6B was described in FIG. 5, and the BaO step 623 is only applicable as a final post-sintering step, where a cathode is pore-diffused with a work lowering function material, and the use of such a work function lowering material requires the pre-formation of pores through a modification to the formulation of ink used to form the cathode layer, as will be described for step 610 cathode ink. Assembly step 625 varies depending on application, ranging from the insertion of the final heater into an external cathode such as shown in FIG. 7, or disposing a monolith which includes an integrated cathode according to another example of the invention into an electron gun.

Examining the steps 600 in detail for a simple heater such as described in FIG. 1, steps 602 and 604 form the tape which will become substrates 106, 108, 110 of FIGS. 2A, 2B, and 2C, respectively. In step 602, Aluminum Nitride powder with particles in the sub-micron grain size range is mixed with a sintering aid such as $Y_2O_3$ (which interacts during subsequent sintering step 618 with the AlN and also the tungsten ink applied in step 610), liquid vehicles which allow the AlN paste to be handled without tearing, and organic binding agents such as polyethylene oxide which allow the AlN paste to be printed and laminated. The binding agents may have an organic part and an inorganic part, where the inorganic part includes some of the ceramic being bound to. One example binding agent is Carbowax® manufactured by Dow Chemical Company. The AlN mixture is formed into a tape and dried in step 604, after which it is suitable for use as carrier substrate (106, 108, 110 of FIGS. 2A, 2B, 2C) after perforation in step 608 in regions which will support conductive paths (also known as conductive vias) through that particular substrate. The perforations are preferably stamped as part of a process step which forms individual layer blanks (106, 108, 110 of FIGS. 2A, 2B, 2C) from a larger sheet, but the perforations may be laser cut, etched, or punched as part of a separate step as well, and typical via perforation diameters range from 0.006 inch to 0.020 inch, and more than a single via perforation can be used in a particular conductor for improved reliability or current carrying capacity. In step 610, a paste of ink containing a powdered refractory metal which can be sintered, such as powdered tungsten, is printed onto each tape layer to form the traces shown in FIGS. 2A, 2B, and 2C. It is preferred to have the sintering agent in the substrate as shown in step 602, although it is also possible to have a sintering agent such as $Y_2O_3$ present in the ink in step 610 or in the substrate in step 602, or in both the ink and substrate, as may be determined by which configuration provides the best sintered trace uniformity and tungsten grain adhesion. In the present embodiment of the invention for an AlN substrate, the sintering agent is mixed only into the AlN substrate in step 602. The printed tungsten ink may be applied 610 by prior art silkscreening techniques with a screen mesh such as 200 mesh/inch to 325 mesh/inch, directly applied using a syringe type dispenser, or using any method which provides for the paste to subsequently sinter into a conductive trace, which can have any width W1, typically greater than 0.005 inch. Areas surrounding substrate perforations for use as conductive vias are also provided with tungsten ink to allow for intra-layer connections at the perforated regions such as 202 and 204 of FIG. 2B, and lands 210 and 212 of FIG. 2C. In step 612, the first through third layers of FIG. 3A are stacked with the perforations aligned where vias are connecting through multiple layers, or the perforations are not aligned where the via provides a single layer change in a conductor. The configuration after stacking step 612 was shown in FIG. 3A. Lamination step 614 is shown in FIG. 4A, where lamination pressure and optional temperature elevation causes the material to flow and form a pre-baked monolith of FIG. 4B. The lamination step 614 is followed by a baking step, whereby binders and agents typically formed from organic compounds having a bakeout temperature of under 600 degrees C. are baked out and removed from the monolith. In one embodiment to be described later, a cathode layer can be formed by printing only the cathode layer in step 610 with a fugitive agent such as low evaporation temperature crystals which are ground and sorted by size which the printed tungsten flows and surrounds in lamination step 614, and the fugitive particles are baked out in step 616, leaving persistent voids in the matrix of cathode tungsten powder of a size suitable for later introduction of BaO or other work function lowering material. The inclusion of fugitive particles in step 610 is typically only performed where a cathode layer is present, although the bakeout step 616 which is used for removing binders is performed not only for fugitive particles but the binders and other agents which may interfere with the high temperature sintering step 618. Low temperature baking process 616 is sufficient to bake out the organic constituents of the binders and other agents associated with the AlN tape step 602 as well as any organic components of binders or other agents present in the ink step 610. After the baking step 616, which may have a temperature in the range of 200 to 600 degrees C., and a baking duration of 4 hours, step 618 sintering with a temperature between 1820 degrees C. to 1850 degrees C. and a sintering time (of 4 hours for tungsten) is applied, after which time the AlN powder has formed into a ceramic, and the tungsten ink has formed into sintered conductive traces suitable for use as heater connectors. Lead attach step 630 is shown in FIG. 7 in conjunction with final assembly step 632 for one example embodiment.

Figure 10A:
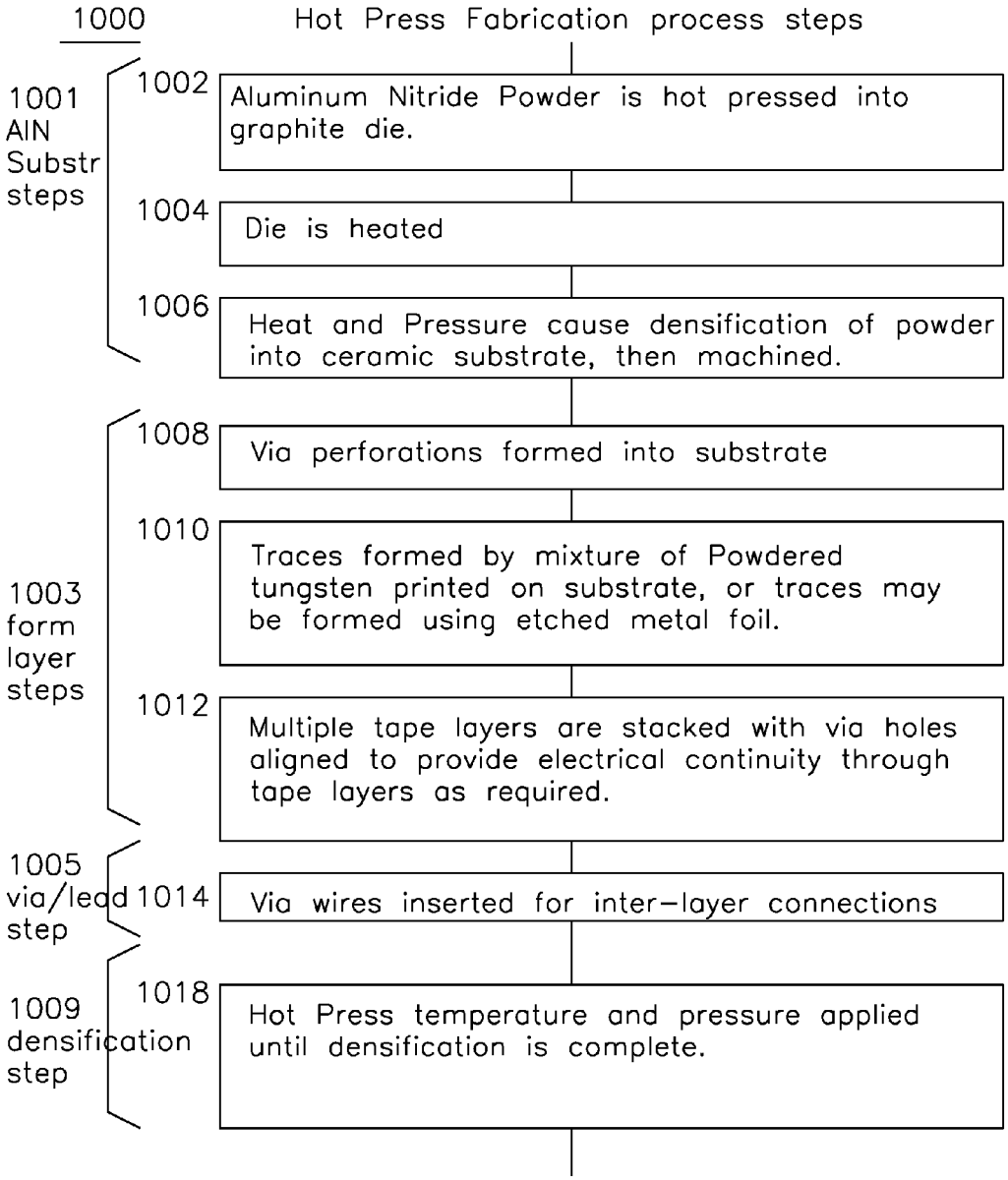
FIGS. 10A and 10B show fabrication process steps for densification using a hot press process.
Figure 10B:
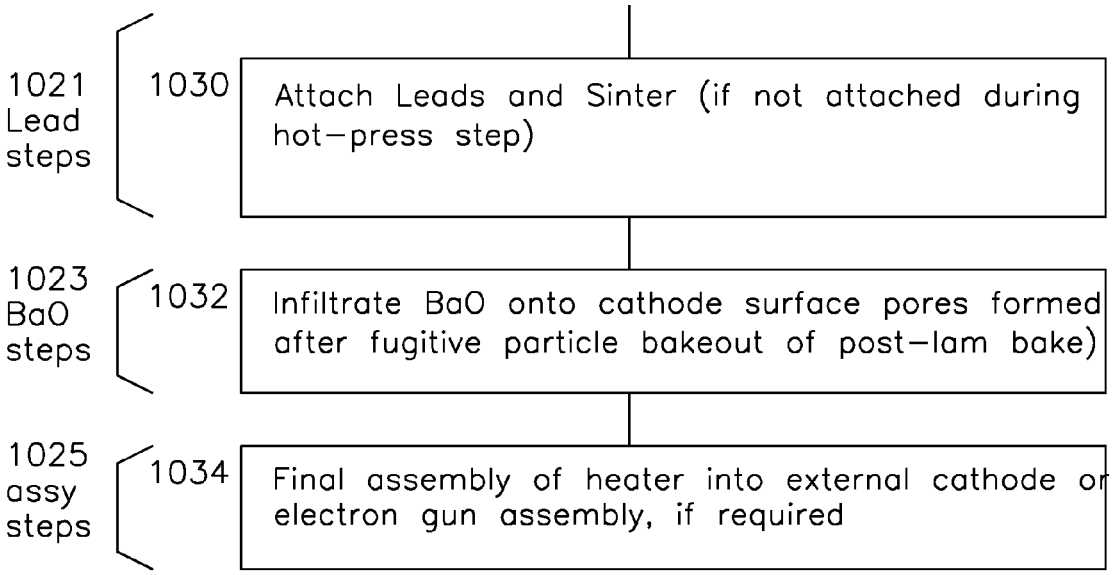

The process flow for FIGS. 6A and 6B show the process for fabrication by application of inks where the densification step 618 which converts the ceramic powder into a consolidated ceramic and the tungsten powder into a sintered conductor. The sintering process of FIG. 6A is shown as only one example densification process for forming the device shown in FIGS. 1, 7, and 8. An alternate process known as "hot pressing" may also be employed, where densification occurs through particle diffusion at high temperature and pressure, and without the use of sintering aids. The steps for fabricating the heater, integrated cathode, or integrated electron gun assembly using a hot pressing process 1000 are shown in FIG. 10A. The ceramic substrate is formed by hot pressing the ceramic powder such as AlN into a graphite die in step 1002, and the ceramic powder typically does not contain a sintering aid as was used in the sintering process. The die is heated 1004 and the heat and pressure cause densification of the powder, forming a ceramic substrate 1006, which is thereafter machined into the desired form. Step 1008 adds the via perforations in the ceramic substrate for connection between layers, as was described earlier. Traces are formed in step 1010 either by etching them onto a refractory metal foil, which is placed on the substrate, or by use of the powdered tungsten powder, which does not contain sintering aids, as the greatly increased pressure of the hot press operation does not require the sintering aids. The layers are stacked in step 1012, and via wires are inserted in step 1014 for inter-layer connections. The layer stack is hot pressed in step 1018 until densification of the ceramic completes, with inter-layer diffusion occurring, which removes the layer boundaries and creates a ceramic monolith with entrapped heater conductors. The leads may be attached using a secondary operation of sintering 1030 as was described previously, or the lead attach 1021 may be combined with the via wire step 1014. The work function lowering operation may be done in step 1032, with final assembly step 1034 completing the operation, and resulting in a structure similar to the one that was produced using the sintering process of FIGS. 6A and 6B. The steps of FIGS. 6A and 6B, as well as FIGS. 10A and 10B may be done in various other sequences, including the combining of similar operations.

The densification of the ceramic powder and tungsten powder into a ceramic structure may be accomplished by any means, but in one example of the invention, the densification reaches a satisfactory level when the porosity of the monolith, expressed as a percentage of the ideal ceramic having no pores, reaches 93% density. Such high density is useful for the ceramic heater and RTD layers, where the reduced porosity and increased density reduces the outgassing of any trapped contaminates. Densification through elevated temperature occurs through consolidation and granular bonding of one metal powder particle or ceramic particle to another (bonding between the tungsten powders, ceramic powders of the substrate, or to each other in sintering, or from one ceramic layer to another during hot pressing).

For an electron emitting cathode, it is desired to provide porosity in the thermionic material for the introduction of work lowering function materials into the pores. This porosity can be accomplished many ways, including by sintering or hot pressing a cathode from refractory powder and selecting the metallic powder grain size and densification level to produce the pore size and density required, which is usually in the range of 1 micron to 100 micron, typically on the order of 20 microns.

Another method for introducing pores into the cathode is through the use of fugitive particles which bake out during the post-lamination baking process of the sintering process, and the pores remain through sintering.

One of the fundamental measurements of a ceramic is its porosity, which may be expressed as a density ratio. Prior to densification, the powdered ceramic has been formed into a monolith which has a particular porosity, or density, and the baking step removes binders, leaving principally the powdered ceramic and unconsolidated voids. A fully consolidated reference density Dfc is considered to be the limit of densification if the green monolith were allowed to fully densify under elevated temperature and pressure. One useful metric is the measure of process densification at a particular point in time, which may be expressed as a percentage of the fully consolidated density with the ratio Di/Dfc, where a value over 93% is considered fully densified.

Another method for introducing pores into the cathode is the use of a low "green density", where the sintering or hot pressing operation is stopped before complete densification, such stopping the consolidation process prior to reaching 55% densification (in contrast with a range of 85-95% with a typical density over 93% for the heater).

Another method for introducing pores into the cathode is to underfire the tungsten metallization layer, so that sintering of the tungsten of the cathode layer is not complete, which then provides the pores required for diffusion of the work function lowering material into the cathode surface.

FIG. 7 shows one example embodiment of an assembled cathode and heater assembly according to the present invention. In one example of the invention, the post-sintered monolithic heater 714 with leads attached in step 632 of FIG. 6B may assembled (step 634) be directly brazing to a cavity in cathode 702 using a material such as tungsten based ink applied between heater 714 and cathode 702 in region 720. Optional backing plate 706 and heat shields 708 may be attached as required. In another example of the invention, the monolithic heater assembly 714 is prepared as described previously including sintering as described in FIG. 4D and lead attachment FIG. 5, and is placed into a cavity formed in sintered tungsten cathode 702. In this example, the cathode is spot welded to a molybdenum cylinder 704, and a backing plate 706 is spot welded 716 to the cylinder 704. Thermal baffles 708 reduce the conduction of heat back to structures near heater leads 710 and 712, and also serve to provide a more uniform temperature at the cathode front surface 702. The baffles may be fabricated from a eutectic alloy, such as moly-ruthinium. It is also possible to arrange the heater conductors such as 112 of FIG. 2B to provide increased thermal generation at the outer diameter of the cathode, which is subject to additional heat loss at the edge of the cathode, and reduced thermal generation at the center of the cathode, where the heat losses are only to the front and rear surfaces of the cathode. The arrangement of conductors on the heater layer will naturally depend on the particular thermal coupling construction of the completed electron gun or related subassembly. In other embodiments of the invention, the front emitting surface of the cathode 702 may be surface or bulk treated with materials which provide enhanced performance. The back surface of the cathode 702 opposite the electron emission surface, and which is in contact with the monolithic heater 714, may be treated on the surface or in bulk with any material known to improve or enhance the performance of the cathode, or improve bonding with the monolithic heater 714. The cathode 702 may be formed in any manner known for electron generation, including a dispenser cathode, or any emission surface shape which is desired or known in the prior art. In another embodiment of the invention, one of the heater leads 710 or 712 may be brazed or welded to the cylinder 716 to provide for a single-lead attachment, if desired.

FIG. 8A shows one example embodiment of an integrated flat cathode and heater assembly 800 in the pre-lamination state of step 612. Heater layer 852 has printed trace metallization 866 and RTD layer 854 has printed trace metallization 864 for temperature measurement use with tungsten ink printed on one side of the AlN substrate, and cathode layer 856 contains tungsten powder ink mixed with fugitive particles sorted for size (such as in the range of 2 to 30 microns) forming layer 868. In one example embodiment, the fugitive particles are formed from a decomposable crystalline material such as ammonium oxalate, and these unsorted particles are formed by crushing and sorting for size such that the pressure of lamination preserves the shape of the fugitive particles surrounded by tungsten powder, the baking process removes the fugitive particles, and the tungsten powder maintains the voids during baking and sintering, such that work function lowering material such as BaO may be added into the persistent voids in a final step. The introduction of BaO into the cathode is done after sintering to avoid BaO loss through evaporation which would otherwise occur during the much higher sintering temperatures. In the embodiment of FIG. 8A, the metallization for each layer is printed onto the side which faces the cathode surface 868, and the heater leads 858, 860 (RTD leads not shown for clarity) are attached using the sintering step of FIG. 5, which may be performed during the monolith sintering step 618, or in a subsequent lead attachment step 630. Cathode lead 862 is attached to cathode layer 868 metallization or to a sleeve using a via through layers 852, 854 and 856 which provides the electrical connection to a lead-side land attachment point on the same surface as leads 858 and 860.

In another embodiment of the invention, a metalized annular ring 870 may be applied to the back side of substrate 852 during fabrication of the integrated heater and cathode layers for subsequent brazing to attachment ring 872. The annular ring 870 may also be used to replace one of the heater leads 858 or 860.

Figure 9A:
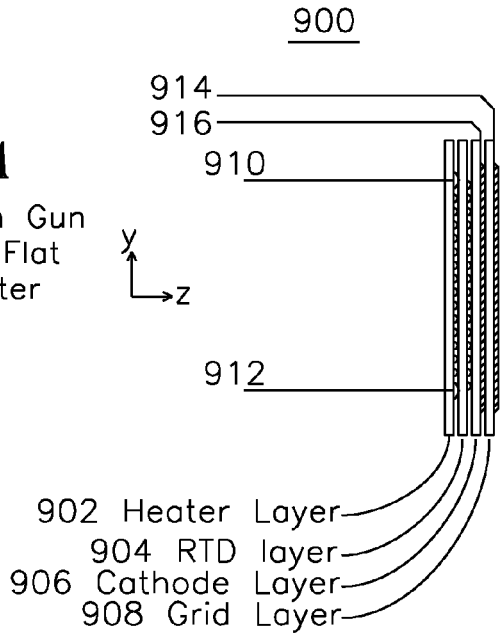
FIG. 9A shows a cross section view of an integrated electron gun having a control grid, flat cathode, and heater assembly.
Figure 9B:
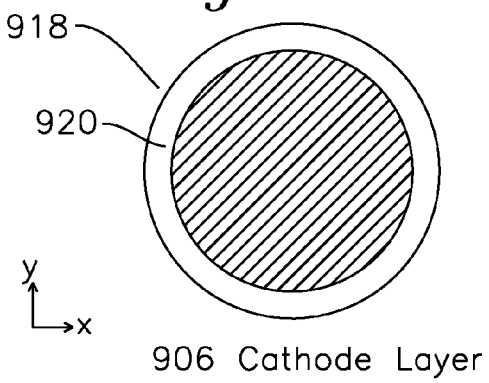
FIG. 9B shows a plan view for the cathode layer of FIG. 9A.
Figure 9C:
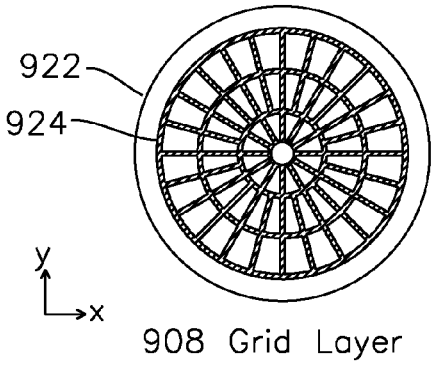
FIG. 9C shows the plan view for the control grid layer of FIG. 9A.

FIG. 9 shows an example embodiment of an integrated electron gun assembly, having a heater layer 902 with heater leads 910 and 912, a heater temperature measurement RTD layer 904 with leads (not shown), a cathode layer 906 also shown in FIG. 9B with substrate 918 and aperture perforations in grid layer 908 which allow infusion of work function reducing material into the thermionic emission layer 920 after sintering of all layers including the cathode layer 920 and grid layer 908 shown in FIG. 9C with grid layer 908 apertures providing access to cathode 920 under the grid substrate 922 and sintered grid metallization 924. The structures of FIG. 9A may be formed as a series of layers, each layer having an AlN substrate and printed with tungsten ink (with the cathode layer printed with tungsten powder ink mixed with fugitive particle material), compressed during the lamination step, baked to create persistent voids, co-fired at a sintering temperature including lead attachment, and then BaO infused in the exposed cathode regions to form an integrated electron gun 900. Alternatively, hot pressing and an optional etched or stamped foil trace layer may be used as described previously.

Figure 11:
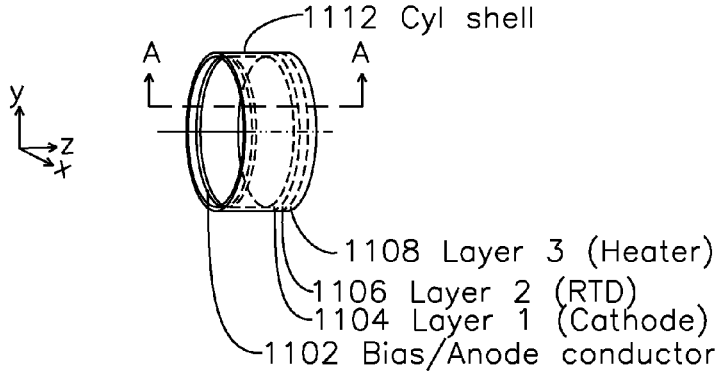
FIG. 11 shows a perspective view of an integrated cathode, anode, and heater.
Figure 12A:
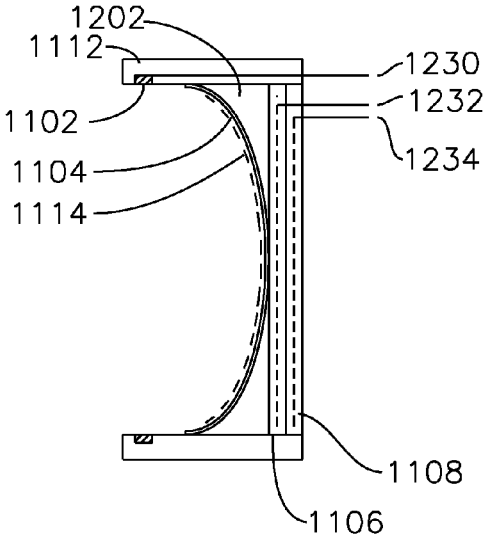
FIG. 12A shows a cross section view of an embodiment of the cathode of FIG. 11.
Figure 12B:
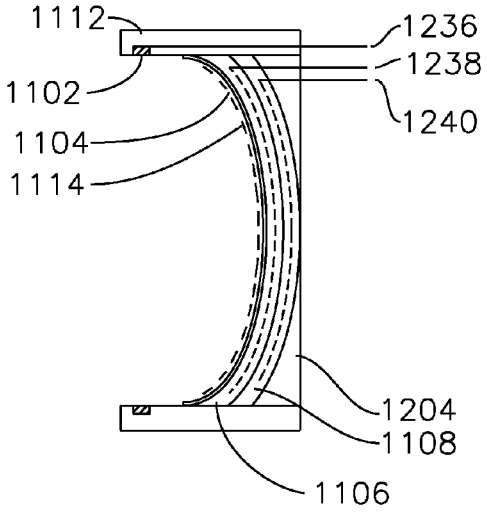
FIG. 12B shows a cross section view of an embodiment of the cathode of FIG. 11.

FIG. 11 shows another example heater integrated with a concave cathode, optional grid layer, and other structures. A cylindrical shell 1112 with a bias/anode annular conductor 1102 is positioned along the electron trajectory of a curved cathode 1104, which is monolithically formed with an RTD layer 1106 and heater layer 1108. FIG. 12A shows a planar heater embodiment, with heater layer 1108 and RTD layer 1106 using planar construction and sintered to cathode 1104 through ceramic 1202, or the RTD layer 1106 and heater layer 1108 may be formed into a concave shape as shown in FIG. 12B, with ceramic 1204 added to provide a planar mounting surface. Annular bias/anode conductor 1102 is coupled to lead 1230 using a via as described previously, either as a wire via or a powdered sintered conductor. RTD lead 1232 (one lead shown for clarity) and heater lead (1234) is attached to a respective RTD and heater layer 1106 and 1108, respectively, in FIG. 12A. FIG. 12B similarly includes annular electrode lead 1102 coupled to lead 1236, RTD layer coupled to lead 1238, and heater lead coupled to lead 1240.

Figure 13:
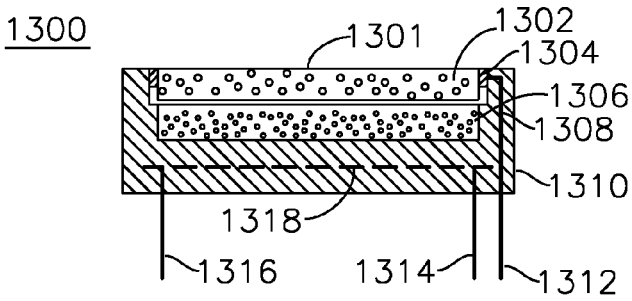
FIG. 13 shows the cross section view of an embodiment for an integrated dispenser cathode.

FIG. 13 shows an integrated dispenser cathode 1300 according to the present invention. Heater traces 1318 are formed as described previously in ceramic body 1310, which includes provisions for heater leads 1314 and 1316, optional RTD layer (not shown), and also has an integrated lead 1308 with a conductive annular ring 1304 applied to the inner surface of the ceramic body 1310. The ceramic body 1310 is fabricated with heater traces 1318 and optionally an RTD layer according to either the hot pressing or sintering processes previously described. The ceramic body 1310 contains a dispenser region 1306 which is filled with a work function lowering material such as BaO, and the cavity is enclosed with the application of cathode 1302 which is formed from a porous refractory metal such as Tungsten. The cathode 1302 may be attached electrically and mechanically using metallized annular ring 1304, which is connected to cathode lead 1312 such as by an internal metallized trace 1308 formed by sintering a metal powder such as tungsten, or with a metal wire. The ceramic body 1310 is preferably formed using AlN, which has a coefficient of thermal expansion which is closely matched to that of the tungsten cathode 1302, and the annular ring conductor 1304 may include a region of partial mechanical connection to provide for any differences in thermal expansion and contraction during operation of the heater 1318 and cathode 1302. The porous cathode 1302 should have sufficient porosity to provide a path for migration of the work function lowering material from the reservoir 1306 through the cathode 1302 pores and to the emission surface 1301.

Figure 14:
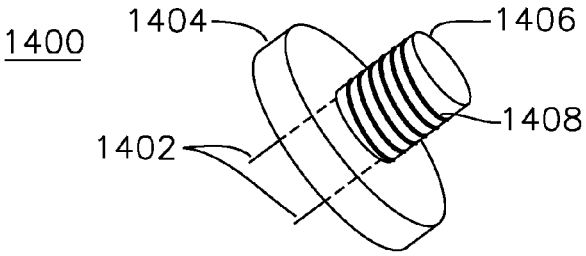
FIG. 14 shows a perspective view of a surface-printed ceramic heater with traces for use with a cathode.

FIG. 14 shows a surface printed cathode heater embodiment 1400 of the invention which may be fabricated with a ceramic substrate 1404 and ceramic post 1406 with conductive traces 1408 attached to leads 1402. Traces 1408 may be fabricated using sintering of refractory powder such as tungsten which may be printed as a paste on either green (predensified) substrate 1404 and post 1406, or the traces 1408 may be printed as a paste after substrate densification, with the traces 1408 sintered in a subsequent step. A conventional sintered powder cathode with a matching cavity may subsequently be placed over post 1406 and bonded using any variety of attachment methods known in the prior art. Preferably, the substrate 1404 and post 1406 are fabricated from AlN and the traces 1408 fabricated using sintered tungsten, with an optional layer of AlN may be placed over traces 1408 to insulate the post from the cathode, thereby achieving close matching in the coefficients of expansion of the cathode (not shown) and heater traces 1408 and post 1406. Where a covering layer of ceramic is applied over traces 1408, the post 1406, traces 1408, and covering layer of ceramic (not shown) are all co-fired and sintered together.

Figure 15:
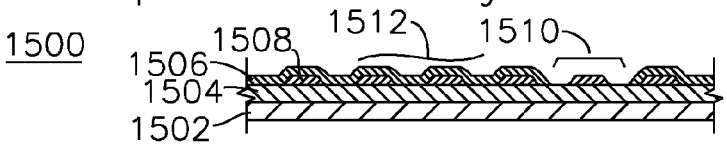
FIG. 15 shows a cross section view of a ceramic liquid coating which is applied to a green or fired ceramic monolith.

FIG. 15 shows an embodiment of the invention where substrate 1502 and 1504 are laminated with conductive traces 1508 printed on the outermost substrate layer 1504. For certain applications, it is desirable to provide a thin insulating layer between the printed traces 1508 and a cathode (not shown) adjacent to surface 1512. The use of a substrate layer was shown in FIG. 4B where substrate 406 isolates trace 408 on one side of the substrate 406 from a cathode on the opposite surface of substrate 406, for the case where the insulating substrate 406 is a green ceramic tape layer which is subsequently fired. FIG. 15 shows an alternate method of achieving this electrical isolation with a thinner insulating layer. Tape substrates 1504 and 1502 have traces 1508 formed from refractory metal powder printed after which a liquid or viscous form of ceramic 1506, is applied, where the liquid ceramic 1506 is of similar composition as substrates 1504 or 1502, but the liquid ceramic 1506 is applied by spraying, screening, or the use of a "doctor blade" which is a thin blade with an edge parallel to the substrate 1504 surface, and drawn across the surface after application of liquid ceramic 1508 to provide a constant thickness of ceramic coating liquid, which ceramic liquid may subsequently conform to the surfaces of the irregular traces 1508. After densification of the liquid ceramic 1506 either as a co-firing step with the underlying green monolith 1504/1502 or as a secondary operation after firing of the underlying monolith 1504/1502, the liquid ceramic layer 1506 becomes a hardened insulator with high dielectric strength, and is suitable for bonding the resultant insulating outer surface 1512 to the back surface of a cathode opposite the emission surface of the cathode (not shown). Certain coating-free areas shown as 1510 where lead attachments and the like are desired may be masked to prevent application of the liquid ceramic. The liquid ceramic 1508 may be applied as a secondary step after traces 1508 and substrates 1504 and 1502 are densified such as by hot pressing or sintering, or it may be applied to the green monolith prior to densification. In one embodiment of the invention, the liquid ceramic is a viscous liquid closely related to the formulation of tape 1502, using a ceramic powder such as AlN, which is understood by the inventors to be preferable for the matching of coefficient of thermal expansion of AlN substrate 1504 with Tungsten traces 1508 and AlN coating 1506 to prevent buildup of stress over thermal heating and cooling cycles.

In another embodiment of the invention, the porosity of the ceramic substrate may be controlled through the selection of the ceramic powder which is densified through sintering or hot pressing. Low porosity may be desirable for improved thermal conductivity with high densification such as in the heater element layers, to control any outgassing, whereas high porosity may be desirable for the subsequent introduction of work function lowering materials into the ceramic adjacent to an enclosed cathode. In another embodiment of the invention shown in FIG. 9A, the heater layer 902, optional RTD layer 904, and cathode layer 906 are formed from low porosity green ceramic, and the grid layer 908 is formed from high porosity green ceramic. After densification, the low porosity substrates of the heater and cathode layer reduce outgassing, and the high porosity substrate 922 allows for the post-densification introduction of work function lowering materials into the substrate 922 layer, where they reside and increase electron production in cathode 920, which free electrons pass through grid metallization 924. For this embodiment, the porous grid substrate 922 is continuous, and the structure may be formed by any of the densification methods described, including sintering or hot pressing.

Control of the porosity of the densified ceramic may be achieved during several of the process steps. In a green ceramic, porosity may be controlled through the use of a narrow range of particles, with larger particles providing greater porosity, and for a given range of particles, the introduction of smaller particles decreases porosity. As described previously, porosity is also controllable through the high temperature consolidation process step through the selection of densification temperature, applied pressure, and sintering or pressing time.

Additionally, it is possible to fabricate an array of integrated cathodes onto a single substrate for use in a multi-cathode electron emission source.

The particular examples provided are intended to aid in understanding the invention, are not intended to limit the scope of the invention. For example, the sintered traces may be formed from any of the refractory metals in powdered form, including Tungsten, Titanium, Molybdenum, Iridium, Ruthenium, Chromium, Hafnium, Niobium, Rhodium, Rhenium, Osmium, Technetium, Vanadium, Tantalum, and Zirconium.

The ceramic may be any powder which can be consolidated under elevated temperature and suitable for a heater or cathode substrate purpose, including AlN (Aluminum Nitride), Al2O3 (Aluminum Oxide), BeO (Beryllium Oxide), Si4N4 (Covalent Silicon Nitride), Y2O3 (Yittrium Oxide), and any of the oxides of the refractory metals.

Accordingly, the sintering agent which reduces the sintering temperature is different for each powdered metal, although it is believed that tungsten and $Y_2O_3$ as a sintering agent sets forth the best mode of the invention. Where the substrate layers are formed by hot pressing of the powder into a ceramic structure, the inter-layer conductors may be formed by etching or otherwise forming refractory metal foils, or by printing as a powdered refractory metal mixed as an ink and without sintering aids present.

We claim:

1. A cathode assembly having an integrated heater bonded to a cathode:

said integrated heater having a plurality of ceramic substrates comprising boundaryless layers of a plastic monolith and densified into a solid ceramic monolith where:

at least one said layer is a substrate having electrically conductive traces containing a refractory metal on at least one of said layers;

said traces are coupled to electrically conductive leads;

said cathode has a concave thermionic emission surface for electron emission, said emission surface including voids containing work function lowering material, and said ceramic monolith is bonded to said cathode opposite said emission surface.

2. The cathode of claim 1 where said bond between said ceramic monolith and said cathode is a brazed bond.

3. The cathode of claim 1 where said bond between said ceramic monolith and said cathode is pressure provided by a backing plate which is on the opposite side of said cathode from a cathode emission surface.

4. The cathode of claim 1 where said electrically conductive traces are a refractory metal foil.

5. The cathode of claim 4 where said refractory metal foil contains at least one of Tungsten, Titanium, Molybdenum, Iridium, Ruthenium, Chromium, Hafnium, Niobium, Rhodium, Rhenium, Osmium, Technetium, Vanadium, Tantalum, or Zirconium.

6. The cathode of claim 1 where said solid ceramic monolith is a sintered solid, said ceramic substrates are sintered Aluminum Nitride tape, and said traces are a refractory metal foil.

7. The cathode of claim 1 where said solid ceramic monolith is densified by hot pressing, said ceramic substrates comprising densified Aluminum Nitride powder and said refractory metal comprising a conductive foil.

8. The cathode of claim 1 where said ceramic monolith contains Aluminum Nitride.

9. The cathode of claim 1 where said solid ceramic monolith contains at least one of AlN (Aluminum Nitride), Al2O3 (Aluminum Oxide), BeO (Beryllium Oxide), Si4N4 (Covalent Silicon Nitride), Y2O3 (Yittrium Oxide), or an oxide of a refractory metal.

10. The cathode of claim 1 where said conductive traces on different layers are placed adjacent to each other and carry counter-propagating currents to minimize a magnetic field generated by said conductive traces.

11. The cathode of claim 1 where one of said boundaryless layers is an RTD layer.

12. The cathode of claim 1 where said boundaryless layers includes more than one layer carrying a cathode heating current.

13. A cathode having a concave thermionic emission surface and an underlying integrated heater, said cathode having a plurality of layers densified into a ceramic monolith, each said layer having a ceramic substrate and optionally a conductive trace;

said thermionic emission surface located on an outer layer of said ceramic monolith, said thermionic emission surface having a porous outer surface substrate layer adjacent to said emission surface, said pores forming voids substantially the size of organic salts before evaporation, said voids containing a work function lowering material;

where layers adjacent to said thermionic emission surface form heater layers, and where at least one said heater layer is a substrate having electrically conductive traces of refractory metal on at least one of said ceramic heater layers and further having:

said traces coupled to electrically conductive leads;

said cathode having a lead attachment.

14. The cathode of claim 13 where said porous outer surface substrate layer is a substantially continuous layer of refractory metal having said pores.

15. The cathode of claim 14 where said refractory metal pores are substantially the same size as fugitive particles.

16. The cathode of claim 13 where said porous outer surface substrate layer is a porous ceramic over a substantially continuous layer of refractory metal.

17. The cathode of claim 13 where said porous outer surface substrate layer has a lower density than at least one of said heater layers.

18. The cathode of claim 13 where said porous outer surface substrate layer contains voids filled with work function lowering material, the voids being larger than the grain size of ceramic particles in said heater substrate.

19. The cathode of claim 13 where said ceramic heater layers have a higher density than said porous outer surface substrate layer.

20. The cathode of claim 13 where said electrically conductive traces on adjacent layers carry counter-propagating current of equal magnitude, thereby substantially cancelling a magnetic field generated by said current.

21. The cathode of claim 13 where said electrically conductive traces are a refractory metal foil.

22. The cathode of claim 13 where said refractory metal contains at least one of Tungsten, Titanium, Molybdenum, Iridium, Ruthenium, Chromium, Hafnium, Niobium, Rhodium, Rhenium, Osmium, Technetium, Vanadium, Tantalum, or Zirconium.

23. The cathode of claim 13 where said densified ceramic monolith contains Aluminum Nitride.

24. The cathode of claim 13 where said ceramic monolith contains at least one of AlN (Aluminum Nitride), Al2O3 (Aluminum Oxide), BeO (Beryllium Oxide), Si4N4 (Covalent Silicon Nitride), Y2O3 (Yittrium Oxide), or an oxide of a refractory metal.

25. The cathode of claim 13 where said traces have a thickness of between 0.0002 and 0.005 inch.

26. The cathode of claim 13 where one of said heater layers is an RTD layer.

27. The cathode of claim 13 where said heater layer includes more than one layer.

28. The cathode of claim 13 where said pores are infused with a work function lowering material.

29. The cathode of claim 13 where said work function lowering material is BaO.

* * * * *